United States Patent [19]

Focke et al.

[11] Patent Number: 4,845,924

[45] Date of Patent: Jul. 11, 1989

[54] PROCESS AND APPARATUS FOR THE PACKAGING OF PAPER HANDKERCHIEFS

[75] Inventors: Heinz Focke, Verden; Jürgen Wach, Bremen, both of Fed. Rep. of Germany

[73] Assignee: Focke & Co (GmbH &n Co.), Verden, Fed. Rep. of Germany

[21] Appl. No.: 139,523

[22] Filed: Dec. 30, 1987

[30] Foreign Application Priority Data

Jan. 17, 1987 [DE] Fed. Rep. of Germany ..... 3701273

[51] Int. Cl.[4] ..... B65H 25/14; B65H 45/16

[52] U.S. Cl. ..... 53/438; 53/230; 53/234; 53/439; 53/528

[58] Field of Search ..... 53/438, 439, 234, 230, 53/223, 228, 529, 530, 528

[56] References Cited

U.S. PATENT DOCUMENTS

| | | | |
|---|---|---|---|
| 1,382,445 | 6/1921 | Smith | 53/230 |
| 1,653,908 | 12/1927 | Hunt | 53/234 X |
| 3,053,024 | 9/1962 | Wexler | 53/234 X |
| 3,504,476 | 4/1970 | Ehrenfried et al. | 53/234 X |
| 4,341,056 | 7/1982 | Leanna et al. | 53/234 X |
| 4,617,780 | 10/1986 | Focke et al. | 53/234 X |

FOREIGN PATENT DOCUMENTS

| | | |
|---|---|---|
| 2322878 | 11/1973 | Fed. Rep. of Germany . |
| 370697 | 7/1963 | Switzerland . |
| 1567994 | 5/1980 | United Kingdom . |

*Primary Examiner*—James F. Coan

*Attorney, Agent, or Firm*—Sughrue, Mion, Zinn, Macpeak & Seas

[57] ABSTRACT

In the production of packs for stacks (10) of paper handkerchiefs, the problem is to give the cuboid pack an exact shape. Whe a stack of paper handkerchiefs is pushed into a pocket (13) of a folding turret (12), the stack (10) is compressed by a press plate (22) movable up and down in the peripheral direction of the folding turret (12) and, in this compressed form, is pushed into the pocket (13) together with a blank (11). On the opposite side of the folding turret, the virtually finished pack is pushed in the radial direction out of the pocket (13) and onto a push-out platform (48) which moves up and down along the periphery of the folding turret and which is temporarily, in particular during the reception of the pack, in synchronism with the folding turret (12). During a standstill phase of the push-out platform, the pack is transferred from the latter to a discharge conveyor (49).

16 Claims, 5 Drawing Sheets

PROCESS AND APPARATUS FOR THE PACKAGING OF PAPER HANDKERCHIEFS

BACKGROUND OF THE INVENTION

The invention relates to a process for the packaging of compressible articles, especially stacks of paper handkerchiefs, into a blank consisting of plastic film or the like. The invention also relates to an apparatus for the packaging of articles of this type.

In the packaging of pulp products, especially stacks of paper handkerchiefs, a considerable problem arises because the articles to be packaged can be compressed to a considerable extent. It is therefore difficult to produce an exact cuboid pack.

SUMMARY OF THE INVENTION

The object on which the invention is based is to provide a process and an apparatus for the packaging of stacks of paper handkerchiefs in particular, by means of which cuboid packs of exact shape can be produced, whilst at the same time the output of the packaging machine is increased considerably.

To achieve this object, the process according to the invention is characterized in that the article (stack of paper handkerchiefs) is compressed before wrapping and is wrapped in compressed form. As a result of the precompressing of the folded paper handkerchiefs which are conventionally arranged on top of one another in layers of ten, a compact exactly shaped pack, in which the stack remains under pre-stress, is obtained.

In the procedure for carrying out the process, the arriving stacks of paper handkerchiefs are compressed and are pushed, in this form, into the pocket of a rotating folding turret, at the same time taking with them a blank consisting of plastic film or the like which lays itself round the stack in a U-shaped manner. The pockets of the folding turret are appropriately made somewhat larger (in terms of width in the peripheral direction of the folding turret) than the compressed stack. It thereby becomes easier for the stack to be pushed in, taking with it the blank. In the pocket, the stack continues to remain under stress, that is to say compressed. During the transport of the stacks by the continuously rotating folding turret, the folding tabs of the blank which project on the radially outer side and on the axial sides are folded and heatsealed. The virtually finished packs pushed out of the pockets of the folding turret have a very exact cuboid shape.

According to the invention, assigned to the folding turret is a stack rocker which is movable up and down in the direction of rotation of the latter and onto which the articles to be packaged, namely the stacks of paper handkerchiefs, are pushed during a momentary standstill in the end position of the cycle of movement, are accelerated to the peripheral speed of the folding turret and are then pushed into an adjacent pocket of the latter. The stack rocker interacts with a pressing rocker which, after a stack has been pushed onto a push-in platform, compresses the stack, that is to say the article to be packaged, from above. This operation takes place during the acceleration of the stack to the peripheral speed of the folding turret, so that the stack can be pushed into the pocket in the radial direction during momentary synchronism between the folding turret or pocket of the latter and the push-in platform of the stack rocker.

A pushing-out station of the folding turret likewise has assigned to it a push-out platform movable to and fro or up and down in a rocking motion, which, when temporarily in synchronism with the folding turret, receives the pack pushed out of the pocket of the folding turret and transfers it to a discharge conveyor during a standstill phase.

A considerable increase in output of the apparatus according to the invention is obtained as result of a two-track mode of operation. According to this, two packs are produced simultaneously on two tracks located next to one another. For this purpose, a single common folding turret with an appropriate dimension in the axial direction is used, and with continuous pockets, each for receiving two packs located next to one another, and common members likewise of appropriate dimension, such as a stack rocker, pressing rocker, pushing-in device, pushing-out device and push-out platform.

Further features of the invention relate to the design of the folding turret and of the members for feeding and djscharging the articles to be packaged and the packs.

An exemplary embodiment of the invention is explained in detail below with reference to the drawings.

DETAILED DESCRIPTION OF A PREFERRED EMBODIMENT

Figure 1:
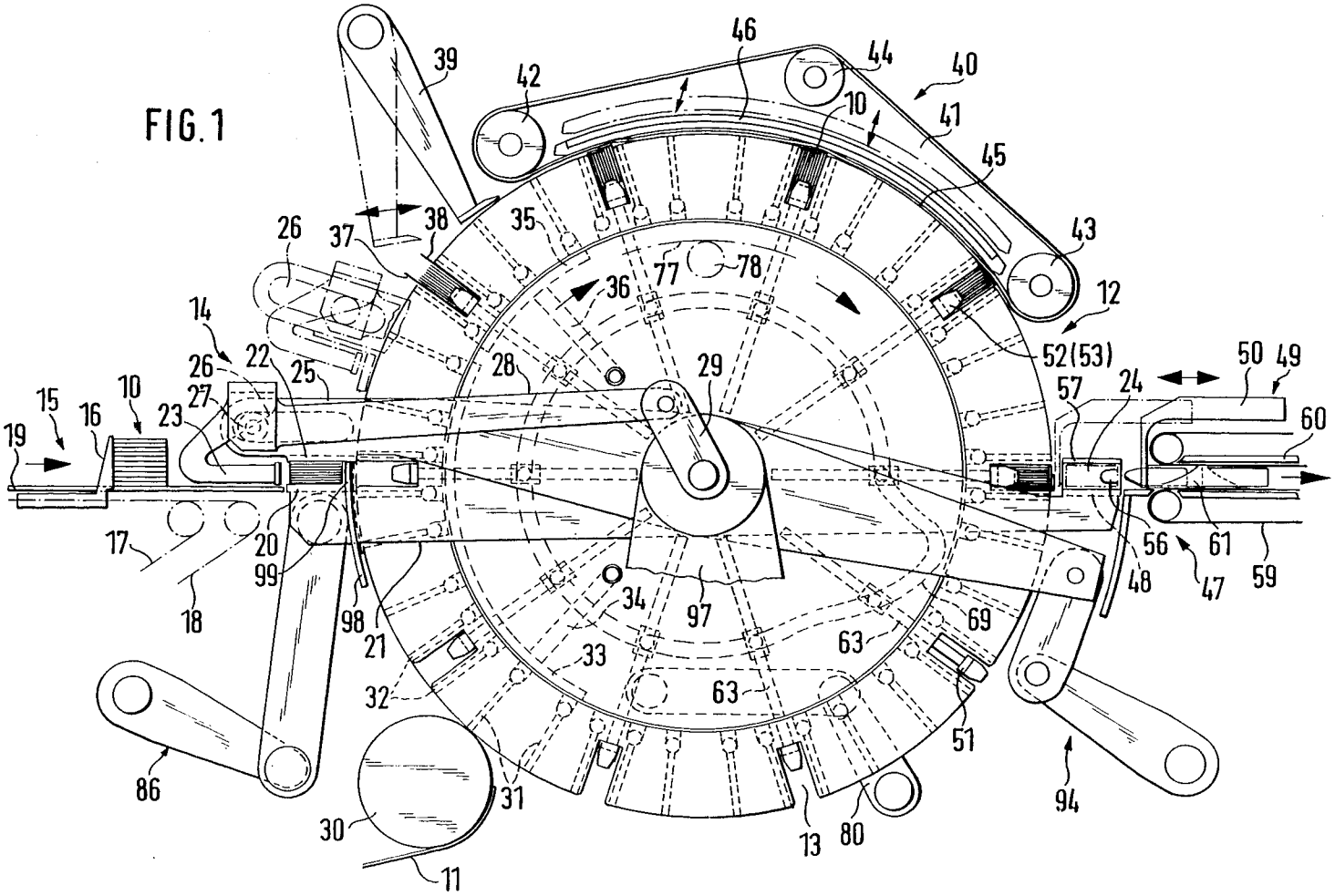
FIG. 1 shows a side view of the apparatus with a folding turret.

The apparatus illustrated as an exemplary embodiment in the drawings serves for the packaging of stacks 10 of paper handkerchiefs. These are laid folded on top of one another, a stack 10 conventionally consisting of ten paper handkerchiefs. The stack 10 is wrapped in a blank 11 consisting of a thin plastic film.

The central unit of the apparatus is a folding turret 12 which is driven to rotate at continuous speed, in the clocwise direction in the representation according to FIG. 1.

The folding turret 12 has a multiplicity of pockets 13 which are arranged distributed along the periphery and in which the articles to be packaged are received individually or in pairs, together with a blank 11. The pockets 13 are open on the radially outer side and at the axial ends.

The stacks 10 are fed to the folding turret 12 in the region of a pushing-in station 14. Leading to this is a feed conveyor 15 extending in a horizontal plane, specifically in the mid-plane relative to the folding turret 12. Here, this is designed as a chain conveyor. Tappets 16 are attached to two chains 17, 18 running next to one another. The stack 10 to be transported rests slidably on a conveying plate 19. The chains 17, 18 are arranged offset in the region of their deflection in such a way that the tappets 16 connected to each chain 17, 18 are moved downwards in parallel, that is to say without pivoting. The stacks 10 supplied can thereby be set down exactly in an end position, without the individual layers being displaced.

The stacks 10 are conveyed by means of the feed conveyor 15 up to a push-in platform 20 provided adjacent to the periphery of the folding turret 12. This platform is arranged on the end of a rocker, namely a stack rocker 21, moved to and fro, in particular in a vertical plane about the centre of rotation of the folding turret 12. The stack rocker 21 is mounted so as to be pivotable coaxially relative to the folding turret 12, and the end projecting beyond the folding turret 12 forms the push-in platform 20.

The stack rocker 21 is movable, together with the push-in platform, out of a lower initial position (the unbroken lines in FIG. 1) into an upper reversing position.(the dot-and-dash lines in FIG. 1). In the lower initial position, the push-in platform 20 extends essentially in the extension of the feed conveyor 15. During a momentary standstill phase, the stack 10 is placed on the push-in platform 20 by the synchronously controlled feed conveyor 15.

Immediately after a stack 10 has been placed on the push-in platform 20, a pressing member, in particular a press plate 22, is activated, which is lowered onto the stack 10 from above and compresses it considerably. In this compressed state, the stack 10 is moved in the direction of rotation of the folding turret by the stack rocker 21, the press plate 22 travelling with it. When the peripheral speed of the folding turret 12 is reached, the stack 10, in compressed form, is pushed in the radial direction by a pushing-in device 23 into the pocket 13, rotating in the same plane, of the folding turret 12. The dimension of the pocket 13 in the peripheral direction corresponds to the size of the pack 24 to be produced. Appropriately, the stack 10 is compressed to a somewhat greater extent than the peripheral dimension of the pocket 13, so that it becomes easier to push it in.

The press plate 22 is attached to the underside of a pressing rocker 25 movable synchronously with the stack rocker 21. This pressing rocker, like the stack rocker 21, is pivotable about the centre of rotation of the folding turret 12. The pressing rocker 25 is moved, together with the stack rocker 21, in the direction of rotation of the folding turret 12, the pressing position being maintained. After the compressed stack 10 has been pushed into the pocket, the pressing rocker 25 returns to the initial position together with the stack rocker 21, but initially at a greater distance from the latter, so that the uncompressed stack 10 can be conveyed freely onto the push-in platform 20.

The pushing-in device 23 is connected to the pressing rocker 25 so as to be relatively movable. The latter is provided, outside the region of the folding turret 12, with an oblong hole 26, in which a guide roller 27 connected to the pushing-in device 23 is movable to and fro. The guide roller 27 is arranged on a link 28, by means of which the pushing-in device 23 is moved to and fro. The link 28 is itself connected to a crank arm 29 pivotable about the axis of rotation of the folding turret 12. A movement of the link 28 causes a linear shift of the pushing-in device 23, the stack 10 being pushed into a pocket 13 at the same time. The pushing-in device 23 is made hook-shaped, so that the stack 10 can be grasped on the outside.

The stacks 10 are pushed into the pockets 13, each taking with it the blank 11 provided in the pushing-in station 14. For this purpose, the blanks 11 are brought, via a deflecting roller 30, up to the periphery of the folding turret 12. This is provided with a multiplicity of suction bores 31, 32 opening onto the peripheral surface. The arrangement of these is such that two suction bores 32 or groups of suction bores 32 are arranged on both sides of each pocket 13. As a result, each blank is secured by means of suction air at its edges at the front and rear in the conveying direction and on both sides of the pocket 13. The suction bores 31, 32 are connected to a vacuum source via a suction segment 33 and a radial suction line 34.

The suction segment 33 extends in the peripheral direction into a region located after the pushing-in station 14. It is then followed by a blowing-air segment 35 which, via a compressed-air line 36, feeds air through the suction bores 31, 32 over a part zone. An air stream stabilizing the radial position of tubular tabs 37 and 38 is thereby generated particularly by means of the suction bores 32 arranged directly on both sides of the pocket 13. These tubular tabs 37, 38 which project on the outside or protrude from the pocket after the stack 10 has been pushed into the pocket 13, together with the blank 11 folded in a U-shaped manner, are now folded, specifically first the tubular tab 37, at the rear in the conveying direction, by a pivotable folder 39 which folds the tubular tab 37 from the rear against the outer side face of the stack 10.

The pocket 13, together with the stack 10 and the partially folded blank 11, thereafter enters the region of a sealing unit 40. This consists of an endless covering band 41 which rotates, moved in particular at the speed of the folding turret 12, and which is made of heat-resistant material, especially a textile Teflon band. The covering band 41 is guided via two deflecting rollers 42, 43 arranged at a relatively long distance from one another and located directly adjacent to the periphery of the folding turret 12. A third deflecting roller 44 is assigned to the rear outer strand of the covering band 41. As a result of the relative position of the deflecting rollers 42, 43, a conveying or jointly running conveying strand fits closely against the peripheral surface of the folding turret 12. Arranged on the outside of the conveying strand 45 is a heating element, in particular an arcuate heating segment 46. This element is made arcuate concentrically relative to the folding turret 12, but is arranged so that it has no permanent contact with the covering band 41 or its conveying strand 45.

When the pocket 13, together with its content, enters the region of the covering band 41, the tubular tab 38 located at the front in the conveying direction is folded round against the outer side face, partially overlapping with the tubular tab 37. During further conveyance, the stack 10 together with the blank 11 enters the region of the heating segment 46. It is important, here, that, as a result of appropriately selected dimensions, the stack 10, including the folded blank 11, should project slightly from the pocket 13 in the radial direction, that is to say protrude beyond the peripheral surface of the folding turret 12. The covering band 41 or its conveying strand 45 is thereby lifted slightly by the stack 10 in the region of a pocket 13, in particular until it comes up against the heating segment 46. The heat for carrying out sealing and also a certain pressure are thus transmitted here locally in the region of the folded tubular tabs 37, 38. The heating segment 46 extends over a region of the folding turret 12 corresponding to the distance between three successive pockets 13, to an extent sufficient to carry out secure sealing.

The heating segment 46 can be adjusted radially, in particular retracted from the heating position, by means of members not shown in detail, when no packs are supplied during an interruption in operation or when the folding turret 12 temporarily stands still.

The pack, finished in respect of the outer tubular fold (tubular tabs 37 and 38) now passes, together with the associated pocket, into the region of a pushing-out station 47. This is located opposite the pushing-in station 14, that is to say in the horizontal mid-plane of the folding turret 12.

Arranged in the region of the pushing-out station 47 and adjacent to the outer periphery of the folding turret 12 is a push-out platform 48. This is moved to and fro or up and down in the peripheral direction of the folding turret 12 in correspondence with the push-in platform 20. The largely finished pack 24 is pushed out of the pocket and onto the push-out platform 48 during a phase of synchronous movement of the folding turret 12 and push-out platform 48. The push-out platform 48 then returns to an (upper) end position which is aligned with a discharge conveyor 49 in the horizontal mid-plane.

In the present exemplary embodiment, the push-out platform 48 is connected to the stack rocker 21 which is extended beyond the axis of rotation of the folding turret 12 and which, opposite the push-in platform 20, receives the push-out platform 48 at the free end. The movements of the push-in platform 20 and of the push-out platform 48 therefore always correspond to one another.

The relative arrangment is such that the push-in platform 20 is moved upwards, after receiving a stack 10, and at the same time the push-out platform 48 is moved downwards for acceleration up to the peripheral speed of the folding turret 12. The transfer of the pack 24 to the push-out platform 48 consequently takes place below the plane of the discharge conveyor 49. During the return of the push-in platform 20 to the initial position, the pushout platform 48, together with the pack, is moved upwards level with the discharge conveyor 49, and during a momentary standstill phase the pack is drawn off from the pushout platform 48 in the radial direction by a hook-shaped pushing-off device and transferred to the discharge conveyor 49.

Each pocket 13 has its own pushing-out device 51 assigned to it. In the retracted initial position, this device is located on the radially inner side of the pocket 13 and thus forms the bottom of the latter. For this purpose, the pushing-out device 51 is designed as a strip which extends over the entire length of the pocket 13 in the axial direction. For the lateral limitation of the otherwise open pockets 13, folding thumbs 52, 53 pointing in the radial direction are arranged laterally on the pushing-out device 51. The axial distance between the folding thumbs 52, 53 corresponds to the length of the stack 10 or pack 24. As a result of the design of the folding thumbs 52, 53, when a stack 10 together with a blank 11 is pushed into a pocket 13, a side tab 54 located at the front in the pushing-in direction is folded. This is the first fold of a known cross-fold formed on the end faces of the pack.

The outer side tab 55 located opposite the inner side tab 54 is folded only when the pack is pushed out of the pocket in the region of the pushing-out station 47. For this purpose, folding thumbs 56 are arranged laterally on the push-out platform 48, which take effect in the opposite direction to the folding thumbs 52, 53 and, when the pack 24 is pushed onto the push-out platform 48, fold the side tab 55 located at the front in the conveying direction. For the better guidance and fixing of the pack, the push-out platform 48 is made pocket-shaped, in particular with a top wall 57 as an upper guide for the pack.

When the pack 24 is pushed into the discharge conveyor 49 from the push-out platform 48, upper and lower longitudinal side tabs 58 are folded. For this purpose, in the entry region of the disharge conveyor 49 there are, attached laterally between a lower band 59 and an upper band 60, folding members, in particular folding tongues 61, by which the upper and lower longitudinal side tabs 58 are folded in a known way during the transport of the packs. The side tabs 54 and 55 folded first are held in position, in this region, by means of angular guide members 62.

In order to push a pack 24 out of a pocket 13 in the region of the pushing-out station 47, the pushing-out device 51 assigned to the pocket 13 is moved in the radial direction. For this purpose, the pushing-out device 51 is attached to radially directed rams 63. Two such rams 63 are arranged on each pushing-out device 51 at a distance from one another in the axial direction and are held slideably in guides 64 inside the turret 12. The radial movement of the pushing-out devices 51 is brought about by lateral cam discs 65, in which a control groove 66 is made. In turn, a guide roller 67 assigned to each pushing-out device 51 runs in this control groove 66. In the exemplary embodiment illustrated, a guide roller 67 is arranged at each of the two ends of a transverse rod 68 connecting the rams 63 to one another.

The control groove 66 of the cam disc 65 is made concentric relative to the folding turret 12 over its predominant extent, so that the pushing-out devices 51 are in the retracted inner position. In the region of the pushingout station 47, specifically below the latter, the control groove bulges radially at 69. This bulge gives rise to the ejecting stroke of the pushing-out device 51 when the pocket 13 and push-out platform 48 rotate adjacent to one another at the same speed.

The pivoting movements of the stack rocker 21 and consequently of the push-in platform 20 and push-out platform 48 are set to an amount of movement (arrows 70) of 18°. As is evident from FIG. 6, an acceleration phase of 4° in the present case and a synchronous phase 72 of 10° are provided. During this, the stacks 10 or packs 24 are transferred into the pocket 13 and out of it respectively.

Figure 6:
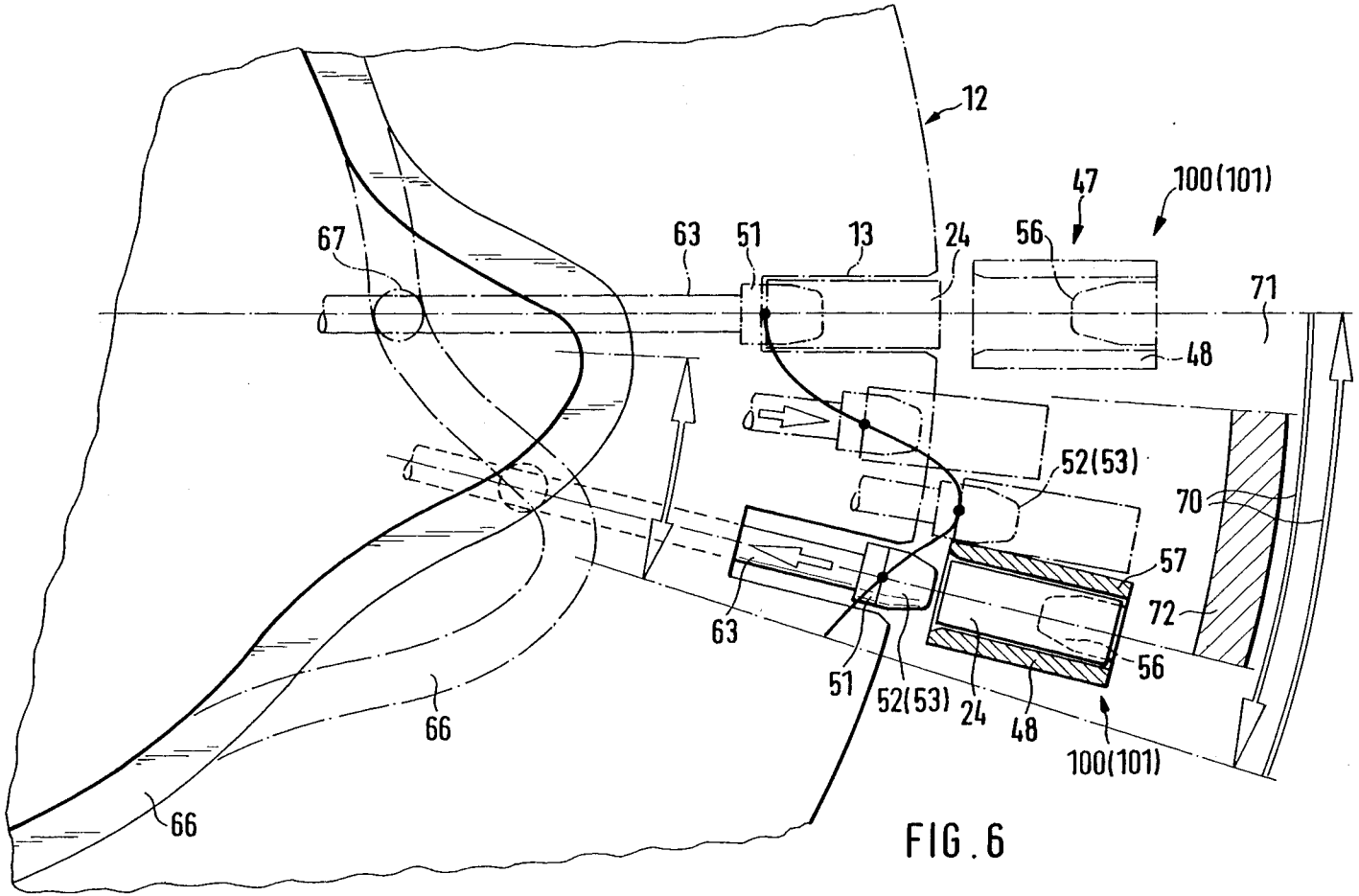
FIG. 6 shows, on an enlarged scale, a detail of the folding turret in the region of the pushing--out station, with members in different positions.

As is also evident from FIG. 6, for the acceleration of the pushing-out operation during this phase, the cam disc 65 is additionally pivoted in the opposite direction to the folding turret, so that the bulge 69 of the control groove 66 moves out of the initial position, represented by dot-and-dash lines in FIG. 6, into the position shown by unbroken lines. This results in a rapid brief radial movement of the rams 63 during the synchronous phase 72.

The apparatus illustrated here is designed for two-track operation in order to increase the productive capacity. Accordingly, two stacks 10 are fed simultaneously, by means of two parallel feed conveyors 15, to the folding turret 12. The dimensions of the latter in the axial direction are such that the two stacks 10 can be received next to one another in a common continuously open pocket 13. In the present case, the folding turret 12 is designed as a hollow body on the principle of construction of the yarn spool, with a cylindrical turret casing 73 and an approximately central radial support 74 on a rotating hub 75. Formed at one edge of the turret casing 73 is a flange 76 which is directed radially inwards and which is designed with an internal toothing 77 extending all round for the engagement of a drive pinion 78.

Figure 2:
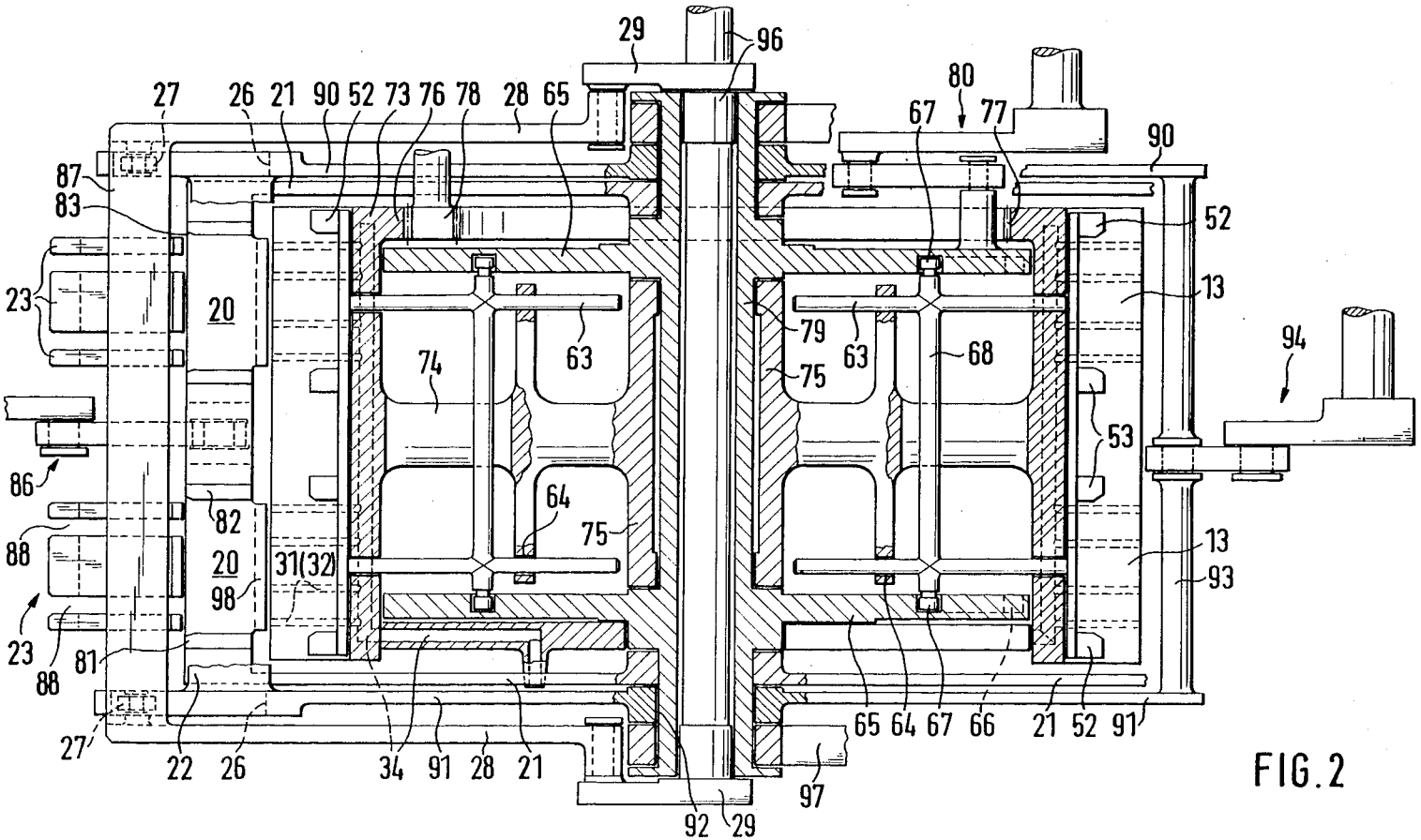
FIG. 2 shows a horizontal section through the folding turret according to FIG. 1.
Figure 3:
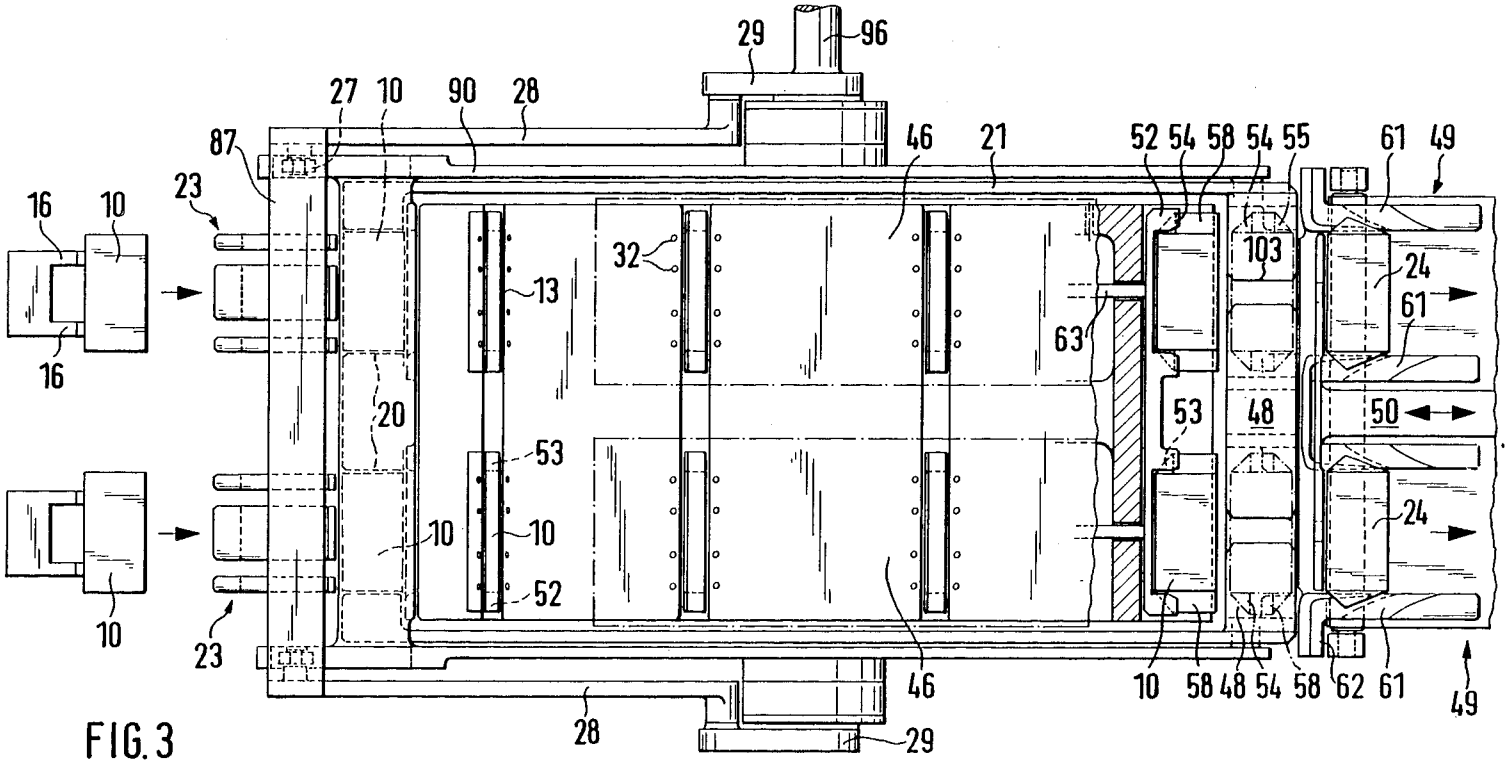
FIG. 3 shows a plan view of the folding turret according to FIGS. 1 and 2.

A cam disc 65 is located on each side within the turret casing 73. The two cam discs are connected to one another via a hollow shaft 79. One of the cam discs 65 (shown at the top in FIG. 2) is driven in a rocking motion by means of a crank mechanism 80, in order to bring about the pushing-out movement described in relation to FIG. 6. The cam discs 65 are moved jointly by means of the hollow shaft 79.

The rams 63 for actuating the pushing-out devices 51 are also located inside the turret casing 73. The guides 64 are connected to the supports 74.

The pushing-out devices 51 extend over the entire axial length of the pockets 13 for receiving two stacks 10. Each strip-shaped pushing-out device 51 is accordingly provided with two pair of folding thumbs 52, 53.

Figure 4:
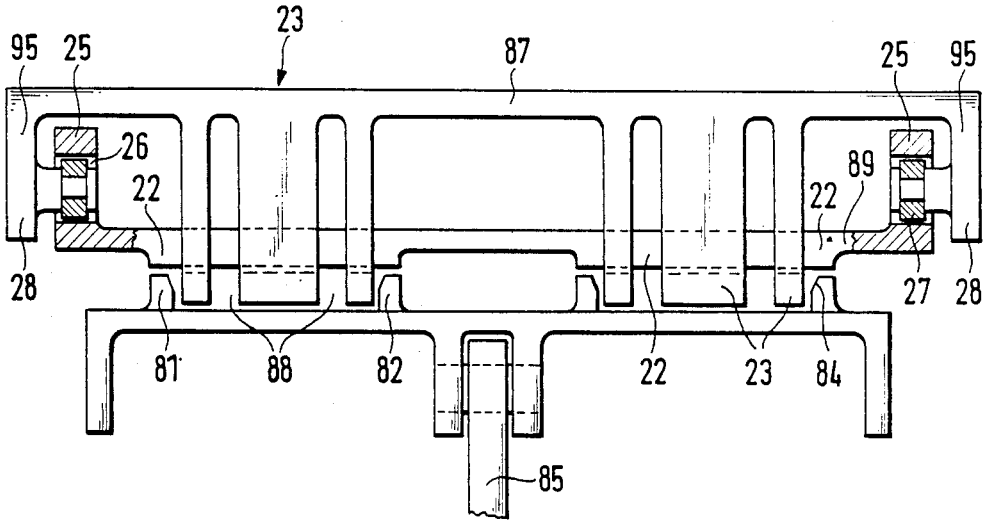
FIG. 4 shows a transverse view of a push-in platform and pushing-in device as a detail on an enlarged scale, FIG. 5 likewise shows a transverse view of a detail of a pushing-out station, in particular a push-out platform.

The push-in platform 20 (FIG. 4) is made in one piece and has a width for receiving two stacks 10. The position of these on the push-in platform 20 continuous in the axial direction is guaranteed by lateral guides 81, 82 which are designed, on the entry side, with a run-in chamfer 83 and also with an upper chamfer 84. The pendulum drive of the stack rocker 21 is attached on the side of the push-in platform 20 and below this. A lever 85 as part of a crank mechanism 86 engages centrally here.

The pushing-in devices 23 for the two production tracks are also designed in a special way. Two pushing-in devices 23 of this type are connected to one another by means of an upper crossmember 87. Each pushing-in device 23 is divided into three by means of vertical slots 88. These are arranged so that, when the pushing-in device 23 is retracted, the correspondingly fork-shaped tappet 16 of the feed conveyor 15 can run right into the region of the pushing-in device 23, in particular because the fork-shaped tappet 16 passes through the slots 88.

Press plates 22 assigned to the two production tracks are arranged on the underside of a supporting beam 89 extending in the axial direction. Adjoining each of its lateral ends is the pressing rocker 25 which accordingly extends on both sides of the folding turret 12 by means of two rocker arms 90, 91 and which is mounted rotatably in a bearing recess 92 of the hollow shaft 79. The pressing rocker 25 or its rocker arms 90, 91 are extended beyond the abovementioned bearing, that is to say beyond the centre of rotation of the folding turret 12. On the side located opposite the pushing-in station 14, the ends of the rocker arms 90, 91 are connected to one another by means of a transverse rod 93. A pivoting drive for the pressing rocker 25, in particular a crank mechanism 94, engages on this rod approximately in the centre. The rocker arms 90, 91 extend as vertical legs on the top side of the supporting beam 89. The two rocker arms 90, 91 are provided, in the region of the push-in platform, with an oblong hole 26 for the guide roller 27 of the pushing-in devices 23. For this purpose, their transversely directed crossmember 87 is provided with downward-directed legs 95, to the inner face of each of which the guide roller 27 is attached.

Two links 28 extending laterally next to the folding turret 12 and intended for the joint actuation of the two pushing-in devices 23 are assigned, as extensions of the legs 95, to the pushing-in devices 23 or to the common crossmember 87. The ends of the links 28 are each connected, in turn, to a crank arm 29. The two crank arms 29 are driven in a rocking motion by means of a common drive shaft 96 which is mounted rotatably in the hollow shaft 79.

The hollow shaft 79 or its bearing recess 92 also serves for the rotatable mounting of the stack rockers 21 likewise extending on both sides of the folding turret 12. Finally, located in each of the two bearing recesses 92 is a bearing block 97 as a supporting stand or machine stand of the folding turret 12.

In order to produce an exact pack 24, a skirt 98 arranged in the region of the pushing-in station 14 extends downwards along a part periphery of the folding turret 12 and fits closely against the periphery of the latter. The skirt 98 is provided, level with the pushing-in platform 20, with an aperture 99 for the passage of the stack 10. The skirt 98 is attached to the press plate 22, in particular to the underside of the latter, and is consequently moved up and down together with it.

Figure 5:
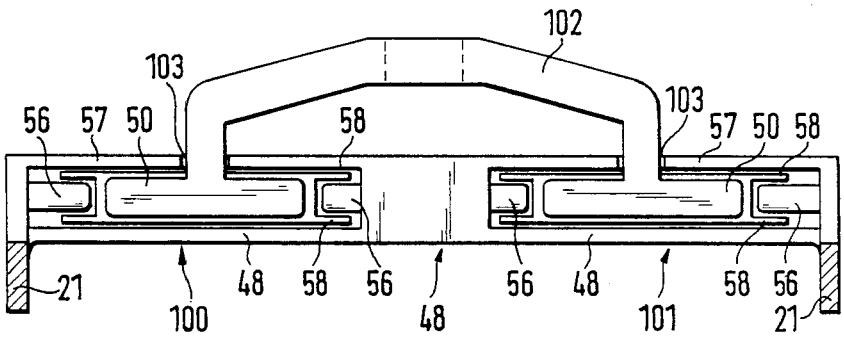

The side of the pushing-out station 47 is also designed for two-track operation. As is evident from FIG. 5, for the two production tracks there is a common continuous push-out platform 48 which is sub-divided into closed push-out pockets 100, 101 by means of the top wall 57 and side walls with folding thumbs 56. Two hook-shaped pushing-off devices 50 assigned to the push-out pockets 100, 101 are connected by means of a crossbar 102 to form a common structure. Two packs 24 are therefore always drawn off from the push-out platform 48. The top wall 57 is provided with slots 103 for the passage of the crossbar 102.

We claim:

1. A process for packaging compressible articles, especially stacks of paper handkerchiefs, in a wrapper blank of plastic film, said process comprising the steps of:

pre-compressing a compressible article before insertion thereof into a pocket of a continuously rotating folding turret (12); and then, inserting the pre-compressed article into the pocket (13) of the continuously rotating folding turret (12) so that the pre-compressed article takes with it the blank (11) in such a manner that the blank warps itself around the pre-compressed article in a U-shaped manner.

2. A process according to claim 1, further comprising the steps of:

in the pocket of the continuously rotating folding turret, folding and heat-sealing tabs of the blank to wrap the article; and then, pushing the wrapped article out of the pocket.

3. Apparatus for the packaging of compressible articles, especially stacks of paper handkerchiefs, into a blank consisting of plastic film, with a continuously rotating folding turret having outwardly open pockets, into which the articles are pushed, taking with them the blank which lays itself round the article in a U-shaped manner, wherein the articles are conveyed, by means of a feed conveyor, onto a push-in platform movable to and fro in the peripheral direction of the folding turret in the region of a pushing-in station and are pushed from this push-in platform into an adjacent pocket in momentary synchronism with the folding action, characterized in that assigned to the push-in platform (20) is a pressing member which compresses the article (10) on the push-in platform (20) from above and which keeps said article in the compressed form until said article is pushed into the pocket (13) of the folding turret (12).

4. Apparatus according to claim 3, characterized in that the article (10) is compressible to a size which is slightly less than the dimension (in terms of width in the peripheral direction of the folding turret 12) of the pocket (13).

5. Apparatus according to claims 3 or 4, characterized in that the push-in platform (20) and the pressing member are arranged respectively on separate rockers, in the form of a stack rocker (21) and a pressing rocker (25), which are pivotable relative to one another in a vertical plane concentrically in relation to the folding turret (12).

6. Apparatus according to claim 5, characterized in that the stack rocker (21), in the lower end position, is level with the feed conveyor (15) or a stationary conveying plate (19), adjacent to which is the push-in platform (20) for receiving an article.

7. Apparatus according to claim 5, characterized in that arranged on the pressing rocker (25) is a pushing-in device (23) which, as result of an axial shift, pushes the article from the push-in platform (20) into the synchronous pocket (13), the pushing-in device (23) being guided in an oblong hole (26) in the pressing rocker (25).

8. Apparatus according to claim 3, characterized in that arranged on the side of the folding turret (12) located opposite the pushing-in station (14), in the region of a pushing-out station (47), is a push-out platform (48) which rocks to and fro in the peripheral direction of the folding turret in correspondence with the push-in platform (20) and onto which largely ready-folded packs (24) pass after being pushed out of the pocket (13), during a movement in synchronism with the folding turret (12).

9. Apparatus according to claim 8, characterized in that the stack rocker (21) is extended beyond the axis of rotation of the folding turret (12) and carries the push-out platform (48) at the end located opposite the push-in platform (20).

10. Apparatus according to claim 8, characterized in that the packs (24) pushed out of the pocket (13) and onto the push-out platform (48) below a horizontal middle discharge plane, and in that, when the push-out platform (48) returns into an upper initial position corresponding to the discharge plane, the packs (24) are conveyed from this.

11. Apparatus according to claim 10, characterized in that the push-out platform (48) is designed as a push-out pocket, with an upper wall (57) and lateral folding members, in the form of folding thumbs (56), for folding side tabs (55) of the blank (11).

12. Apparatus according to claim 5, characterized in that the pressing rocker (25) is extended beyond the axis of rotation of the folding turret (12), and the free ends are connected to one another by means of a transverse rod (93), and in that a drive, in the form of a crank mechanism (94), engages on the transverse rod (93).

13. Apparatus according to claim 3 characterized in that arranged in the pockets (13) of the folding turret (12) are strip-shaped pushing-out devices (51) which are pushed out in the radial direction by radially directed rams (63) with guide rollers (67) running in control grooves (66) of cam discs (65), folding thumbs (52, 53) being arranged at a distance from one another on the pushing-out devices (51) as a lateral limitation of the pockets (13).

14. Apparatus according to claim 3, characterized by two production tracks, the folding turret (12) common to both production tracks having axially continuous pockets (13), each with a continuous pushing-out device (51).

15. Apparatus according to claim 14, characterized in that the push-in platform (20) and/or the push-out platform (18) are designed as continuous members which are common to both production tracks and which each extend adjacent to the folding turret (12) beyond the total length of the latter.

16. Apparatus according to claim 5, characterized in that the stack rocker (21) and/or the pressing rocker (25) extend on both sides of the folding turret (12) and are mounted rotatably at the ends of a hollow shaft (79) concentric relative to the folding turret (12), especially in a bearing recess (92) of said turret.

* * * * *